US009974701B1

(12) United States Patent
Haskell et al.

(10) Patent No.: US 9,974,701 B1
(45) Date of Patent: May 22, 2018

(54) RAPID INTERVENTION DRAG AND LIFT STRETCHER DEVICE WITH LEG PROTECTION, SIX POINT LIFT CAPABILITY, AND INFLATABLE BLADDER SUPPORT/FLOATATION MECHANISM

(71) Applicant: MFT Internal Inc., West Islip, NY (US)

(72) Inventors: Frank Haskell, West Islip, NY (US); Thomas J. Fee, South Hempstead, NY (US); Michael P. Harty, West Islip, NY (US)

(73) Assignee: MFT Internal Inc., West Islip, NY (US)

( * ) Notice: Subject to any disclaimer, the term of this patent is extended or adjusted under 35 U.S.C. 154(b) by 831 days.

(21) Appl. No.: 13/957,743

(22) Filed: Aug. 2, 2013

Related U.S. Application Data

(63) Continuation-in-part of application No. 13/476,558, filed on May 21, 2012, which is a continuation-in-part of application No. 12/025,028, filed on Feb. 2, 2008, now Pat. No. 8,286,284.

(60) Provisional application No. 60/887,932, filed on Feb. 2, 2007, provisional application No. 60/980,768, filed on Oct. 17, 2007.

(51) Int. Cl.
*A61G 1/01* (2006.01)
*A61G 1/013* (2006.01)

(52) U.S. Cl.
CPC ..... *A61G 1/013* (2013.01)

(58) Field of Classification Search
CPC ..... A61G 1/01
USPC ..... 5/627–628, 625, 89.1, 81.1 T
See application file for complete search history.

(56) References Cited

U.S. PATENT DOCUMENTS

| | | | |
|---|---|---|---|
| 722,456 | A | 3/1903 | Reeves |
| 2,279,694 | A | 4/1942 | Martinson |
| 2,788,530 | A | 4/1957 | Ferguson |
| 2,899,692 | A | 8/1959 | Finken |
| 3,158,875 | A | 12/1964 | Fletcher |
| 3,424,134 | A | 1/1969 | Rosenblum |
| 4,124,908 | A | 11/1978 | Burns et al. |
| 4,159,010 | A | 6/1979 | Mitro |
| 4,283,068 | A | 8/1981 | Keyser |
| 4,679,260 | A | 7/1987 | Frettem |
| 4,937,923 | A | 7/1990 | McEntire |
| 4,970,739 | A | 11/1990 | Bradford |
| 5,027,833 | A | 7/1991 | Calkin |
| 5,044,031 | A | 9/1991 | Sherwood et al. |
| 5,050,254 | A | 9/1991 | Murphy |

(Continued)

FOREIGN PATENT DOCUMENTS

| | | |
|---|---|---|
| EP | 0301614 | 2/1989 |
| EP | 1400227 | 3/2004 |
| GB | 1536191 | 12/1978 |

OTHER PUBLICATIONS

PCT/ISA/237 Written Opinion issued on PCT/US2008/052868 (pp. 4).

(Continued)

*Primary Examiner* — Fredrick C Conley
(74) *Attorney, Agent, or Firm* — The Farrell Law Firm, P.C.; John F. Gallagher, III

(57) ABSTRACT

An emergency drag stretcher is disclosed that combines a base panel formed of a flexible sheet material and a harness including an inflatable bladder. The harness securely restrains an individual, allowing for drag or vertical lift rescue.

11 Claims, 9 Drawing Sheets

(56) References Cited

U.S. PATENT DOCUMENTS

| | | | |
|---|---|---|---|
| 5,058,575 | A | 10/1991 | Anderson |
| 5,121,514 | A | 6/1992 | Rosane |
| 5,189,746 | A | 3/1993 | Horie |
| 5,435,323 | A | 7/1995 | Rudy |
| 5,539,945 | A | 7/1996 | Rosenberg et al. |
| 5,701,619 | A | 12/1997 | Ullman |
| 5,720,303 | A | 2/1998 | Richardson |
| 5,729,850 | A | 3/1998 | Eskeli |
| 5,787,529 | A | 8/1998 | Landes |
| 5,839,137 | A | 11/1998 | Butler et al. |
| 5,960,480 | A | 10/1999 | Neustater et al. |
| 5,978,989 | A | 11/1999 | Chavez |
| D421,413 | S | 3/2000 | Calkin |
| 6,128,796 | A | 10/2000 | McCormick et al. |
| 6,363,936 | B1 | 4/2002 | McCormick et al. |
| 6,634,044 | B1 | 10/2003 | Wright |
| 6,851,145 | B2 | 2/2005 | Smith et al. |
| 6,871,368 | B2 | 3/2005 | Calkin |
| 6,880,702 | B1 | 4/2005 | Colorado |
| 7,086,091 | B2 | 8/2006 | Jordan |
| 7,168,110 | B2 | 1/2007 | Girard et al. |
| 7,222,378 | B2 | 5/2007 | Dupree et al. |
| 7,596,815 | B2 | 10/2009 | Grilliot et al. |
| 7,607,184 | B1 | 10/2009 | Goodner, Jr. |
| D608,253 | S | 1/2010 | Giduck |
| 7,665,152 | B2 | 2/2010 | Sloan et al. |
| 7,699,324 | B2 | 4/2010 | Walkingshaw et al. |
| 7,865,986 | B2 | 1/2011 | Smart |
| 8,430,204 | B1 * | 4/2013 | Reynolds ..... 182/3 |
| 2004/0128767 | A1 | 7/2004 | Hood |
| 2006/0061050 | A1 | 3/2006 | Wolf et al. |
| 2006/0169534 | A1 | 8/2006 | Green |
| 2007/0136950 | A1 | 6/2007 | Zuercher |
| 2008/0018067 | A1 | 1/2008 | Small |

OTHER PUBLICATIONS

PCT/ISA/210 Search Report issued on PCT/US2008/052868 (pp. 3).

Skedco, Mass Casualty Haz-Mat/Decontaminable (HMD) Sked Stretcher—Brochure.

* cited by examiner

100

494
492
450
452
454
T
413
412
440A
440B
SL
SL
101
SL
P
P
465
465
472
482
414
415
P
P
B
480
470

RAPID INTERVENTION DRAG AND LIFT STRETCHER DEVICE WITH LEG PROTECTION, SIX POINT LIFT CAPABILITY, AND INFLATABLE BLADDER SUPPORT/FLOATATION MECHANISM

PRIORITY

This application claims priority to U.S. Provisional Application No. 60/980,768 filed Oct. 17, 2007, to U.S. Provisional Application No. 60/887,932 filed Feb. 2, 2007, to International Application No. PCT/US08/52868 filed Feb. 3, 2008, and to U.S. Provisional Application No. 61/488,014 filed May 19, 2011, and is a continuation in part application of U.S. application Ser. No. 12/025,028, filed Feb. 2, 2008, and issued as U.S. Pat. No. 8,286,284, and is a continuation in part application of U.S. application Ser. No. 13/476,558, filed May 21, 2012, each of which are incorporated herein by reference.

BACKGROUND

1. Field of the Invention

The present invention relates generally to an emergency rescue device and method for operation thereof that enables rapid removal of an injured individual from hazardous locations and, more specifically, to an emergency rescue device that combines a base panel formed of a flexible sheet material and a harness coupled to the base panel to securely restrain the injured individual.

2. Description of the Related Art

Stretchers of various types have been developed to move injured individuals from emergency situations, for example an individual found injured in a burning building or a soldier injured on a battlefield. A conventional emergency stretcher is provided by Skedco, Inc. that combines features of a sled and a skid, often referred to as a 'SKED', components of which are disclosed in U.S. Pat. No. 6,871,368 to Calkin.

The injured individual is secured within the SKED device, which is skidded across varied types of terrain. Plastic used to construct the SKED device has a shape memory, and the SKED device requires an inefficient and time consuming process to secure the injured individual. Moreover, the SKED device does not provide a self-contained packing arrangement to protect the straps and does not deploy with the straps positioned for immediate deployment. Rather, a separate cover is needed to protect the straps of the SKED device. Use of the separate cover further delays deployment of the SKED device. Accordingly, the SKED device does not provide an efficient process to secure the injured individual. The delays in deploying the SKED device are undesirable, particularly in emergency situations.

Another conventional drag-style emergency evacuation stretcher is disclosed by U.S. Pat. No. 7,699,324 to Walkingshaw et al., which, like the SKED device, utilizes conventional seat-belt style straps to secure an injured individual therein and fails to provide a self-contained packing arrangement that protects the straps from the elements while maintaining the straps in a stored state for immediate deployment.

Yet another conventional stretcher is U.S. Pat. No. 7,168,110 to Girard et al., which discloses a transfer stretcher and harness for lifting, transferring or supporting a person via a single lift point, typically by use of lifting equipment.

However, the transfer stretcher of Girard is not arranged for use as an emergency evacuation stretcher, particularly when immediate deployment is needed, such as for fire rescue and battlefield scenarios.

However, deployment of conventional stretchers requires emergency personal to follow numerous, time-consuming steps to secure the injured person in the stretcher.

SUMMARY OF THE INVENTION

The present invention provides an apparatus and method providing a lightweight, readily compactable, rescue device for evacuation and emergency use including transporting, dragging and lifting of an injured individual.

An aspect of the present invention provides an emergency rescue device that combines a base panel formed of a flexible sheet material and a harness, with the harness having straps that fasten to a single location to securely restrain an injured individual while simultaneously holding the base panel against the individual, thereby allowing the individual to be dragged or vertically lifted using the stretcher device, while the base panel protects the individual.

Another aspect of the present invention provides a rescue device that includes a harness bag for storing harness straps therein, to protect the straps during periods of non-deployment and facilitates expedited strap deployment. The harness bag includes a plurality of reinforced slots/slits through which the straps, including haul straps, shoulder straps, waist straps and groin straps, extend from within the harness bag interior. In a non-deployed state, excess strap slack is releasably held within the harness bag with connecting ends of each strap, including mating fasteners, being releasably secured on an exterior surface of the harness bag, with the straps passing through respective slots/slits. When in a deployed state, end portions of the straps are extracted from the harness bag to wrap the straps around the individual who is being restrained in the harness device.

A further aspect of the present invention provides a rescue device with a base panel removably coupled to a harness for securing an individual to be rescued when the rescue device is in the deployed state, with the harness being enclosed within and protected by the base panel when the rescue device is in the non-deployed state, when the base panel and the harness are rolled into a storage state.

DETAILED DESCRIPTION OF EXEMPLARY EMBODIMENTS

Figure 1:
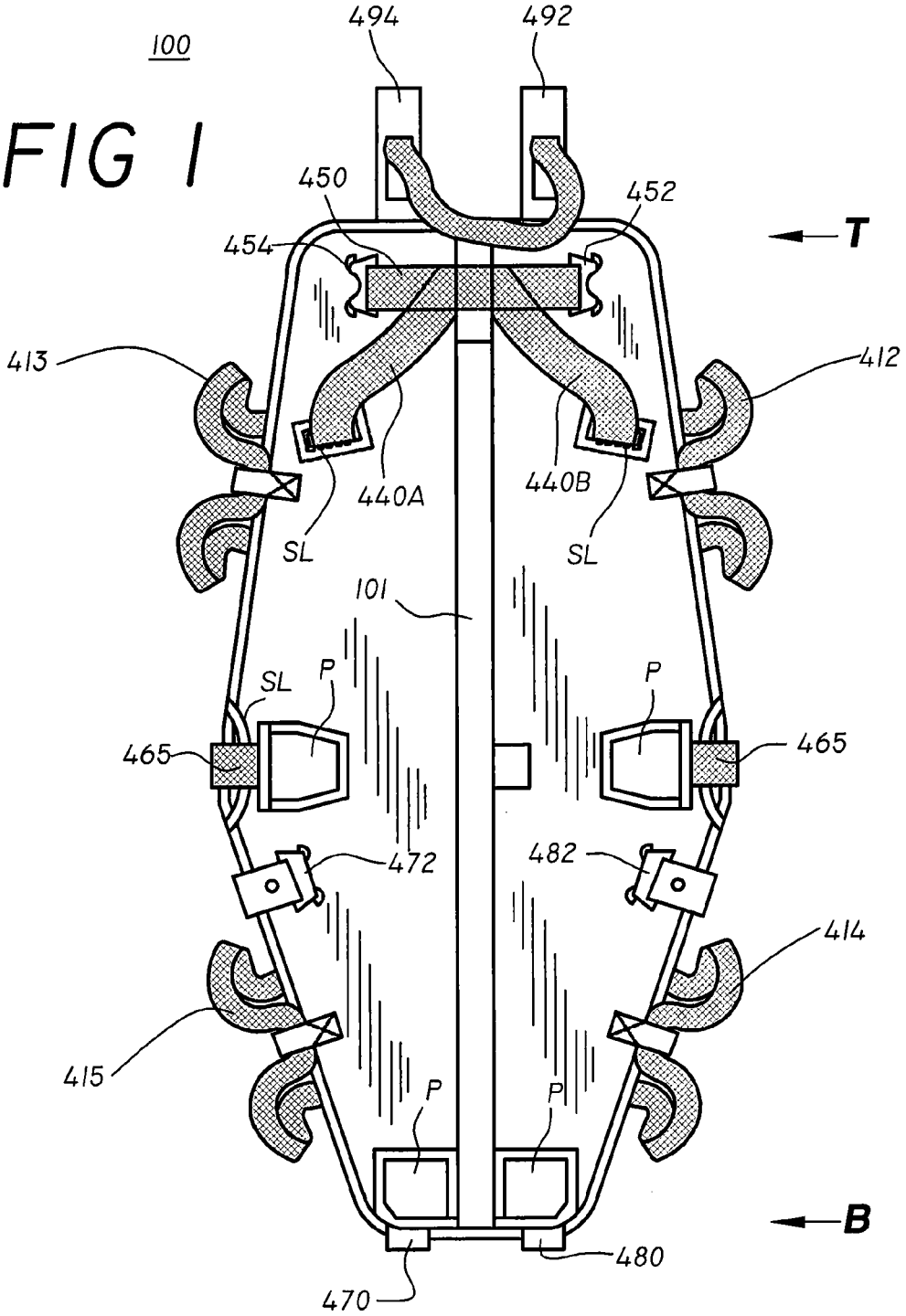
FIG. 1 illustrates a harness bag of the rescue device of the present invention unrolled flat with harness straps in a non-deployed state.
Figure 2:
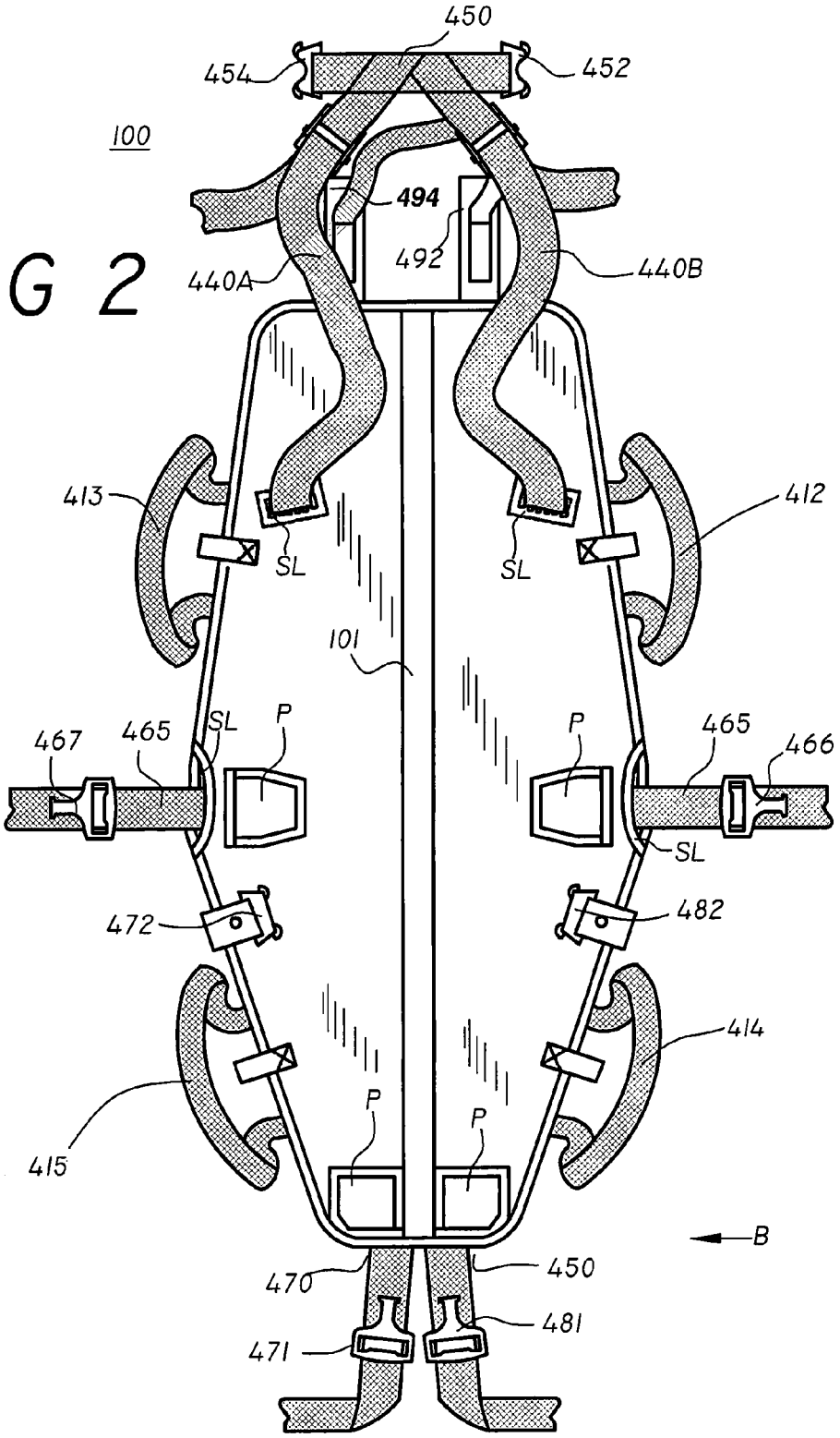
FIG. 2 shows the harness bag of the FIG. 1 with harness straps extended therefrom.

FIGS. 1-4 illustrate a rapid intervention rescue device according to a first exemplary embodiment of the invention. Harness bag 100 has a top end (T) and bottom end (B) (FIGS. 1-2). A base panel 10 is removably secured to one side of harness bag 100 (FIGS. 3-4), preferably secured by mating Velcro™ strips. Like the other components, base panel 10 preferably has a low to high operating range between −60 to 140 degrees F. Harness bag 100 includes an elongated reclosable opening 101 (FIGS. 1-2, 5-6), to allow for resetting of straps to a non-deployed state after deployment, as described below.

To facilitate deployment in under one minute, base panel 10 of rescue device 400 is preferably formed of a flexible, non-shape retaining, material, e.g. polyurethane, having a hardness and durability sufficient to protect an individual being rescued when dragged along the ground or other rough surface, and to provide rigidity for elevated rope extractions, e.g., building and mountainous terrain extraction, airlift and hoist operations.

Figure 3:
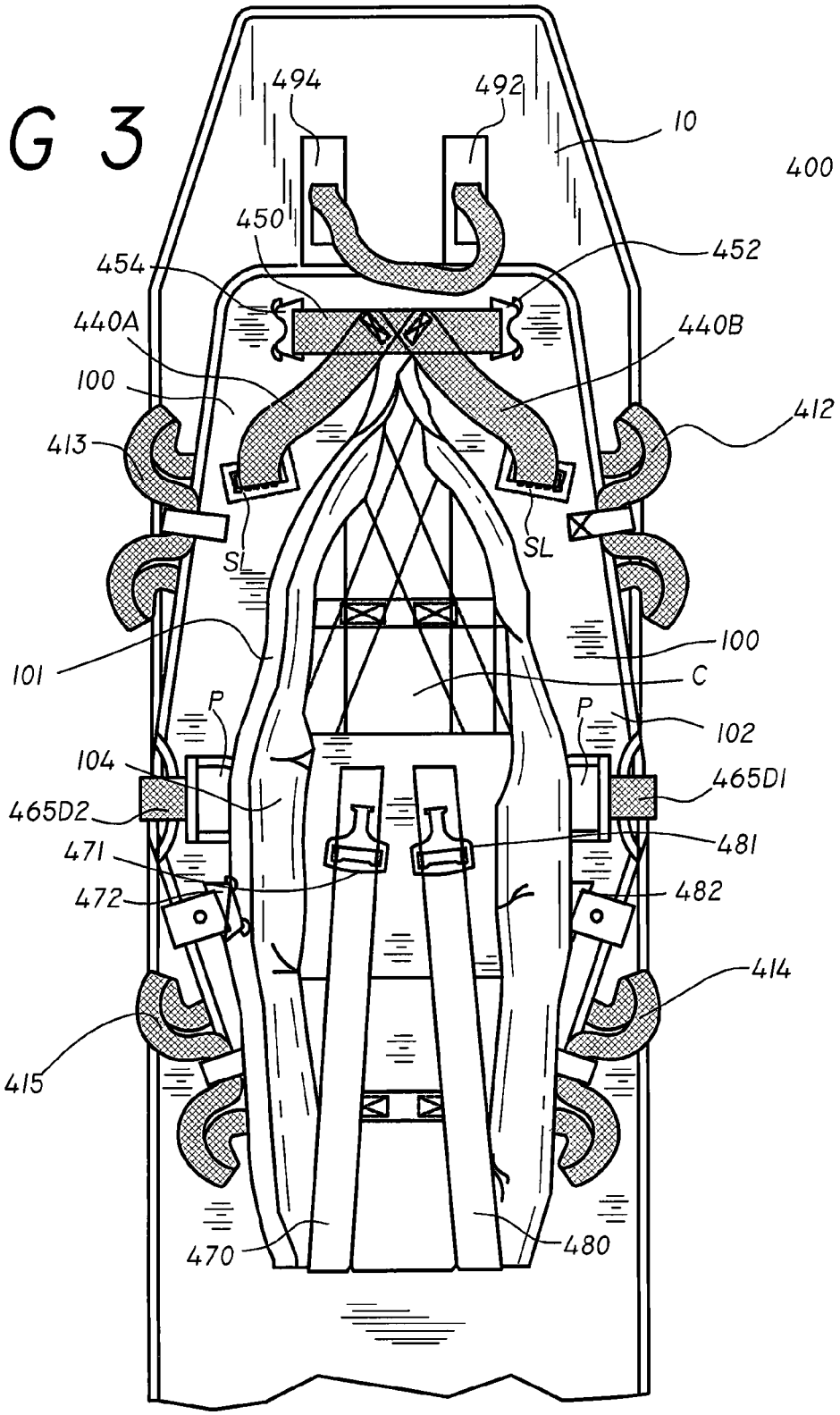
FIG. 3 shows the harness bag of FIG. 1 opened to expose an interior cavity thereof with the harness bag affixed to a base panel.
Figure 4:
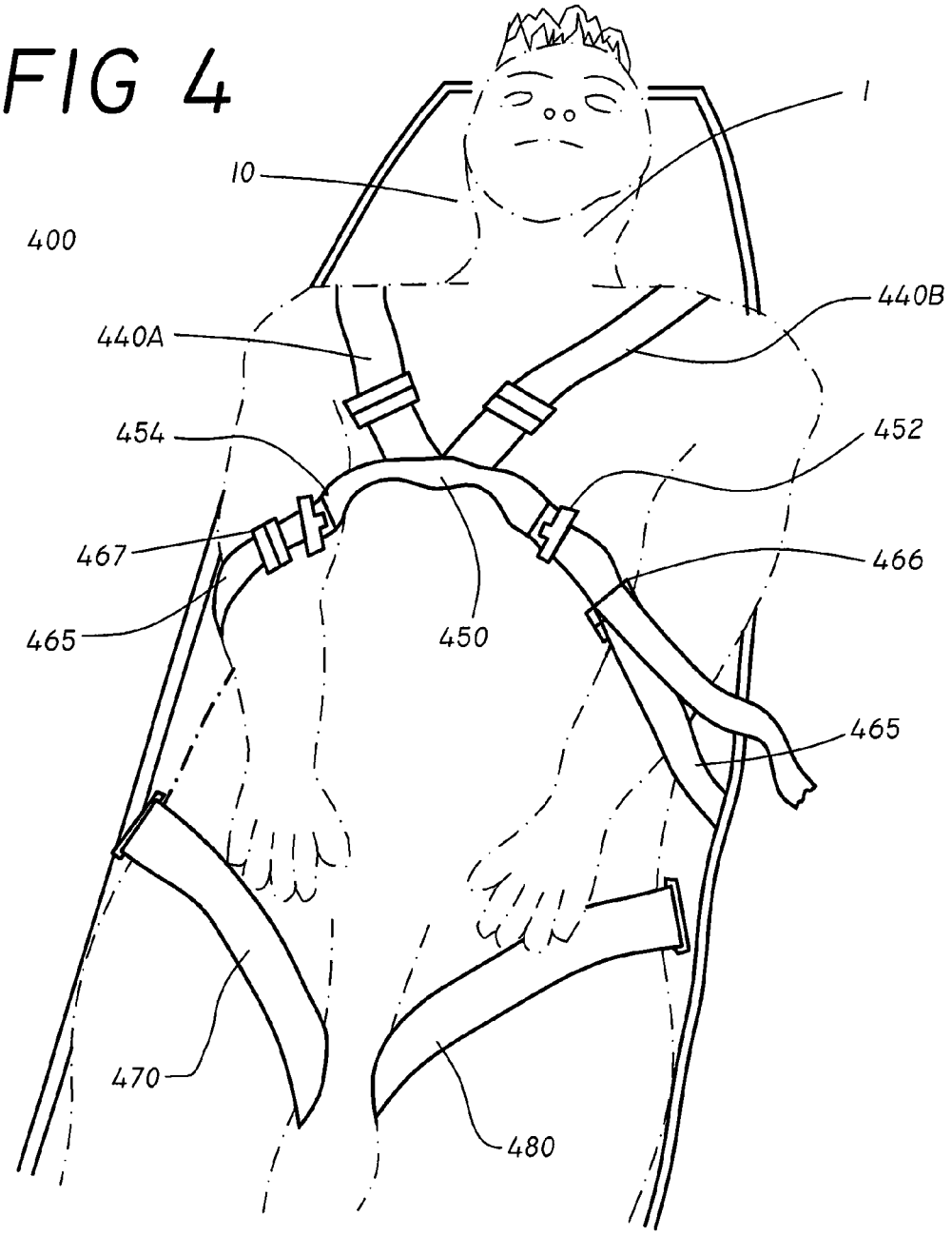
FIG. 4 shows an individual secured in the rescue device of FIGS. 1-3.

FIG. 1 shows harness bag 100 in an unrolled and non-deployed state, with excess slack of each harness strap releasably secured within the harness bag 100 and distal ends of each harness strap releasably secured on an exterior surface of harness bag 100. First through fourth lift points 412-415 (FIGS. 1-3) provide a stabile lift system for use in hoisting operations during rescue of individual, such as during airlift. Harness bag 100 is preferably secured to base panel 10 (FIGS. 3-4). Straps holding individual (I) within rescue device 400 are preferably rated to at least 4000 lbs.

FIG. 2 shows harness bag 100 with shoulder straps 440A, 440B, extracted therefrom. Distal ends of the shoulder straps 440A, 440B are fixedly interconnected by stitching distal ends to shoulder strap connector 450, which has fastener devices 452, 454 affixed to respective opposite ends thereof (FIGS. 1-4).

Pockets (P) are preferably provided on the exterior of harness bag 100 to releasably hold distal ends of waist strap 465 and leg straps 470, 480 when in the non-deployed state (FIGS. 1-2). FIG. 2 shows waist strap 465 and leg straps 470, 480 removed from respective storage pockets P. First and second connectors 466, 467 (FIG. 2) are provided on opposite ends of waist strap 465.

When deployed, distal ends of shoulder straps 440A, 440B are extracted from harness bag 100 by pulling on shoulder strap connector 450, thereby extending shoulder straps 440A, 440B through respective slits SL in harness bag 100. An individual I being rescued is secured by looping strap connector 450 over the head of individual I, resulting in harness straps 440A, 440B resting on respective shoulders of individual I (FIG. 4). Distal ends 465D1, 465D2 (FIG. 3) of waist strap 465 connect to twin fastener devices 452, 454 of shoulder strap connector 450 to secure the torso and arms of individual I, as shown in FIG. 4.

Leg straps 470, 480 (FIGS. 1-4) extend to provide a restraint system that expeditiously, i.e. in less than one minute, secures arms and legs of the individual (I) during transport. The restraint system prevents individual (I) from slipping and sliding within restraints of harness and also provides horizontal and vertical hoist capability.

Interior cavity (C) (FIG. 3) of harness bag 100 retains and protects a majority of shoulder straps 440A, 440B, waist strap 465, and leg straps 470, 480 in the non-deployed state. Shoulder straps 440A, 440B, waist strap 465, and leg straps 470, 480 are releasably secured using snaps or strap mechanisms provided in interior cavity (C). For clarity, excess slack of the shoulder straps 440A, 440B and other straps is not shown in FIG. 3.

Proximal ends of pull straps 492, 494 are fixedly attached to the harness (FIGS. 1-3) to allow an individual secured in rescue device 400 to be moved by pulling pull straps 492, 494, which are preferably configured for attachment to a locking device rated at 50001*b* or more, such as a locking D-ring, for securing to a hoist cable.

A method is provided for operating rescue device 400 by unrolling base panel 10, harness bag 100 and leg protector 300; placing individual (I) being rescued in the unrolled rescue device 400; releasing shoulder strap connector 450 of distal ends of shoulder straps 440A, 440B from an exterior surface of harness bag 100 and pulling shoulder strap connector 450 with shoulder straps 440A, 440B over the head of the individual (I); and wrapping waist strap 465 around the waist of the individual. For airlift and hoist operations, the individual's legs are also secured, as described below.

As shown in FIG. 4, the shoulder harness includes straps 440A, 440B that facilitate the individual's (I) head between straps 440A, 440B and shoulder strap connector 450, which secures distal ends of straps 440A, 440B. Shoulder strap connector 450 includes first and second waist strap receivers 452, 454, preferably being female parts of quick release fasteners that allow for rapid tensioning of straps 440A, 440B to accommodate different size individuals. The quick release fasteners remain closed when under load, such as AustriAlpin COBRA™ quick release stab-lock fasteners. Preferred embodiments also include fasteners disclosed in U.S. Pat. No. 4,937,923 to McEntire and in U.S. Pat. No. 7,073,235 to Benedict. Corresponding male ends of the quick release fasteners are provided on first and second ends 466, 467 of waist strap 465.

First and second leg straps 470, 480 secure respective legs of the individual (I), with distal ends thereof each including a quick release fastener that connect to first and second leg strap receivers 472, 482 (FIGS. 1-3), respectively. Shoulder straps 440A, 440B, shoulder strap connector 450, waist strap 465, and leg straps 470, 480 form the harness, which is removably coupled to a base panel (10). Shoulder straps 440A, 440B pass through corresponding slots SL1, SL2 (FIGS. 1-3, 5-6) of harness bag 100 to securely couple the harness and the harness bag 100.

Figure 5:
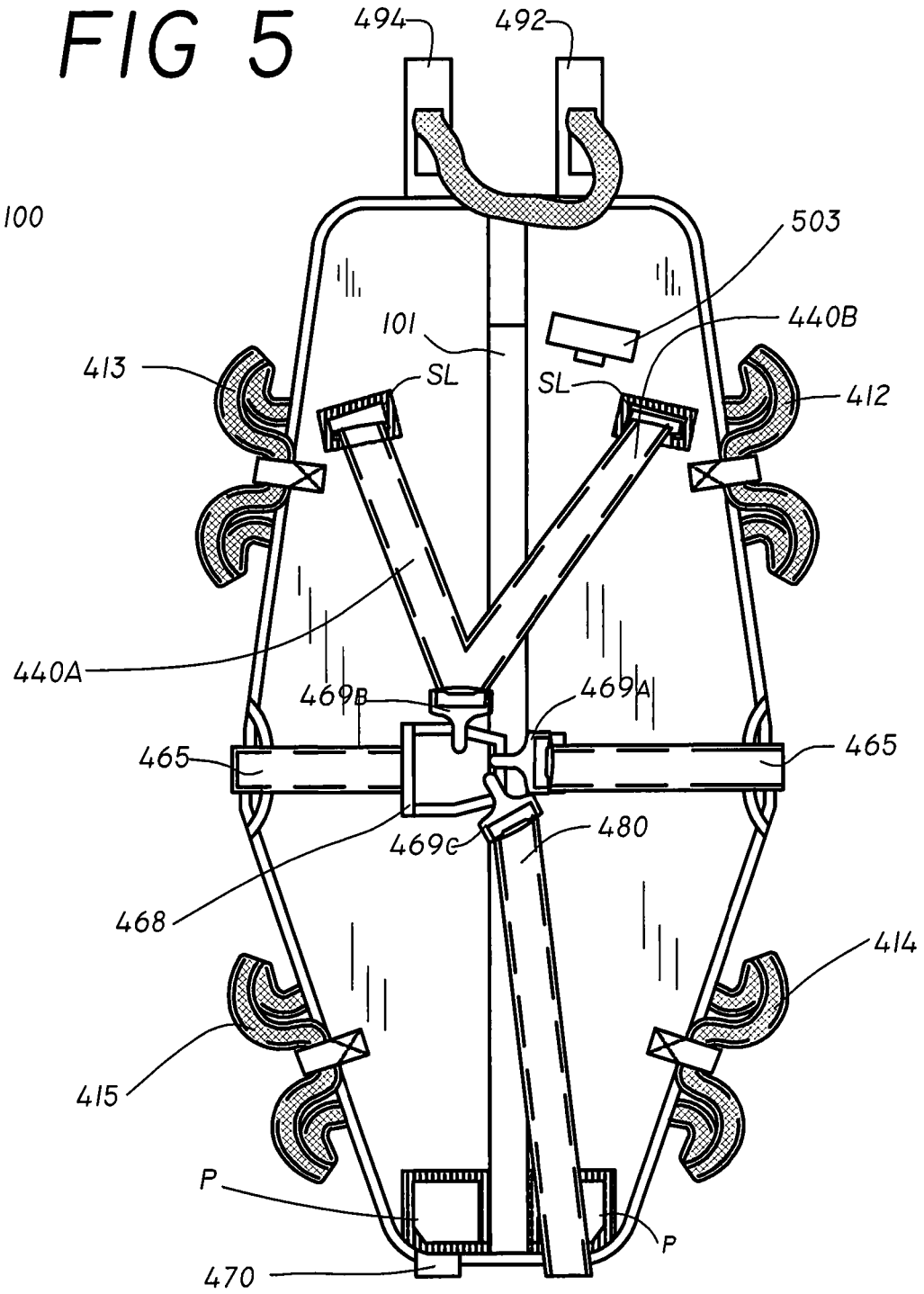
FIG. 5 shows an alternative embodiment of the harness of the present invention with straps deployed as a five point harness.

In an alternative embodiment, a D ring 468 is provided on one end of waist strap 465 (FIG. 5). The opposite end of waist strap 465 is provided with a first hook 469*a* that clips onto D ring 468. A second hook 469*b* is provided at an interconnected distal end of shoulder straps 440A, 440B and a third hook 469*c* is provided at a distal end of second leg strap 480. Extension, i.e., deployment of each of waist strap 465, interconnected shoulder straps 440A, 440B, and second leg strap 480, and clipping each of respective first through third hooks 469*a*, 469*b*, 469*c* onto D ring 468, provides a five point harness to secure an individual in the harness, with second strap passing between the legs of the rescued individual.

A further embodiment provides a six point harness (FIG. 6), with first leg strap 470 including a fourth hook 469*d* on a distal end thereof. For use as the six point harness, first leg strap 470 is also extended from the interior of harness bag 100 and fourth hook 469*d* additionally clips onto D ring 468, with first and second leg straps 470, 480 preferably passing over respective legs of the individual being rescued.

Figure 6:
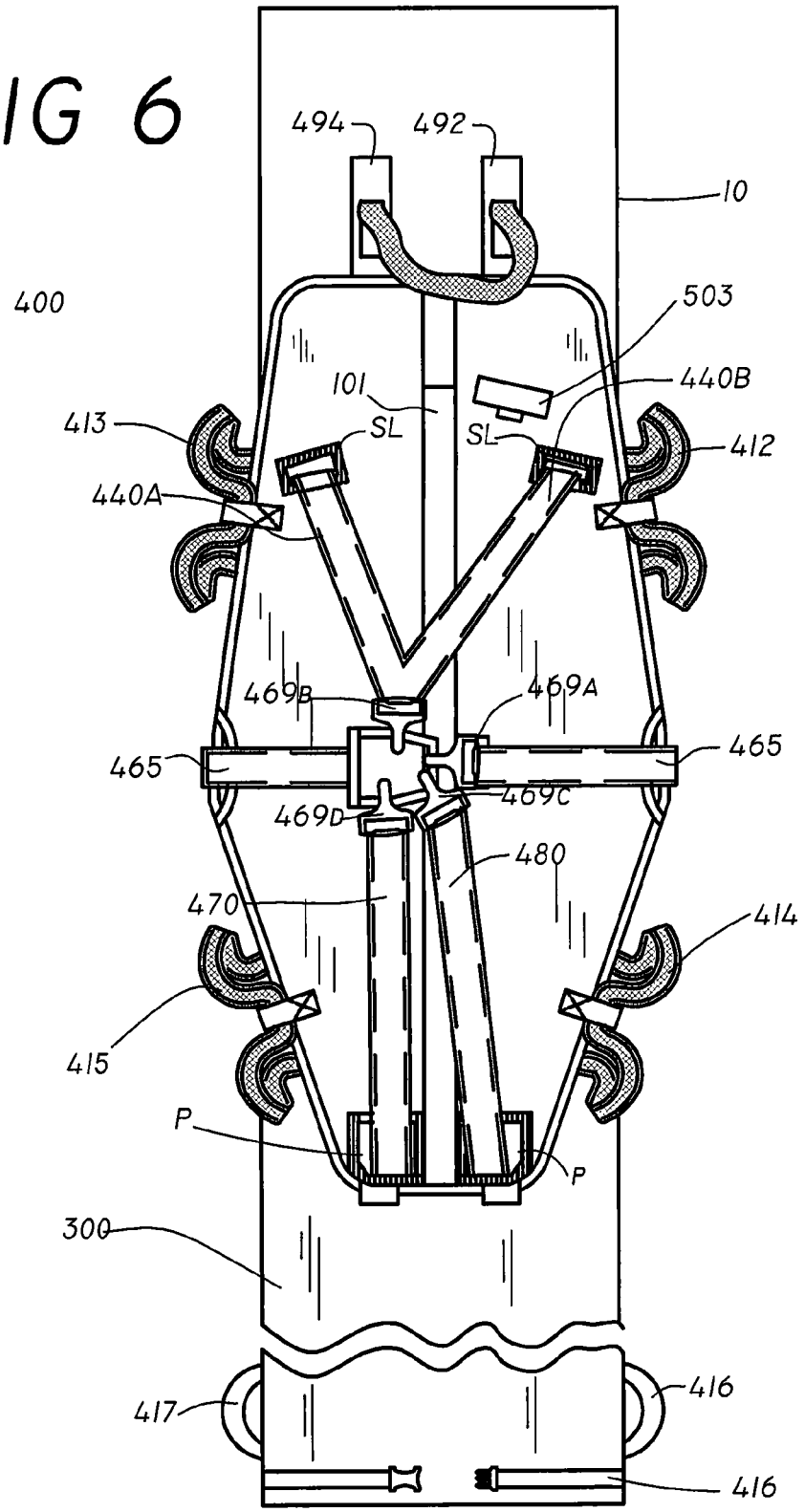
FIG. 6 shows the harness of FIG. 5 affixed to a base panel with a leg protector extending from a bottom end thereof with straps deployed as a six point harness.

FIG. 6 also shows leg protector 300 affixed to a bottom end of harness bag 100 and base panel 10. Leg protector 300 is preferably a reinforced cloth or durable canvas material that is foldable for storage between harness bag 100 and base panel 10, at the bottom end thereof. When extended from the bottom end of harness bag 100, use of select pull straps 492, 494 and/or first through sixth lift points 412-417 allow for horizontal and/or vertical hoist capability. In addition, when coupled to harness bag 100 and base panel 10, the extended leg protector (300), as well as the entire rescue device adopts a substantially uniform overall longitudinal curvature.

The extended leg protector (300) provides a rigid, form-fitting full-body material that provides a surface that immobilizes individual (I) and does not interfere with airway maintenance while providing support if splinting of lower extremities is necessary. A lower pull handle (not shown) is also preferably provided for reverse drag of a secured individual (I). Moreover, inflation of bladder 500 (FIG. 8, described below) cushions individual (I) secured in rescue device 400 against hazards and shock that may occur during rescue, particularly when the rescue operation involves lifting or dragging over an uneven surface or along an extended distance, regarding which the present device is particularly well suited, for example for evacuation of injured troops from a field of combat. Moreover, ropes secured to the upper and lower pull handles allow oppositely positioned rescuers to precisely control evacuation across uneven terrain, without risk to the rescuers.

Figure 7:
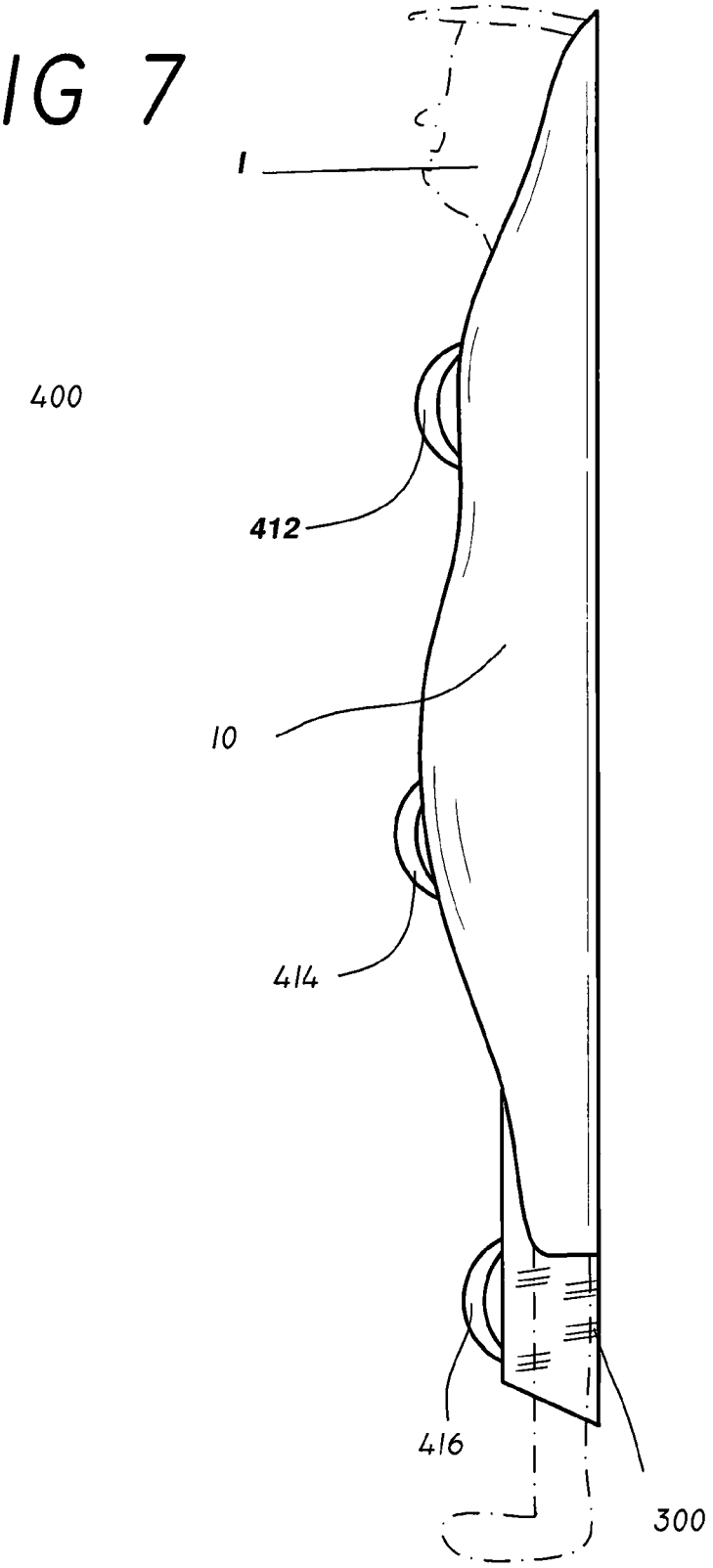
FIG. 7 is a profile view showing an individual secured within the device of FIGS. 5-6.

Leg protector (300) provides fifth and sixth lift points 416, 417 (FIG. 6) for improved stability during lifting operation, and to ensure that the rescue device remains horizontal during in flight hoist operation. Leg protector 300 additional includes leg straps 422, 424 (FIG. 6) to secure and immobilize the rescued individual's legs. FIG. 7 provides a profile view of individual (I) secured within rescue device of FIG. 6, for six point lifting.

Figure 8:
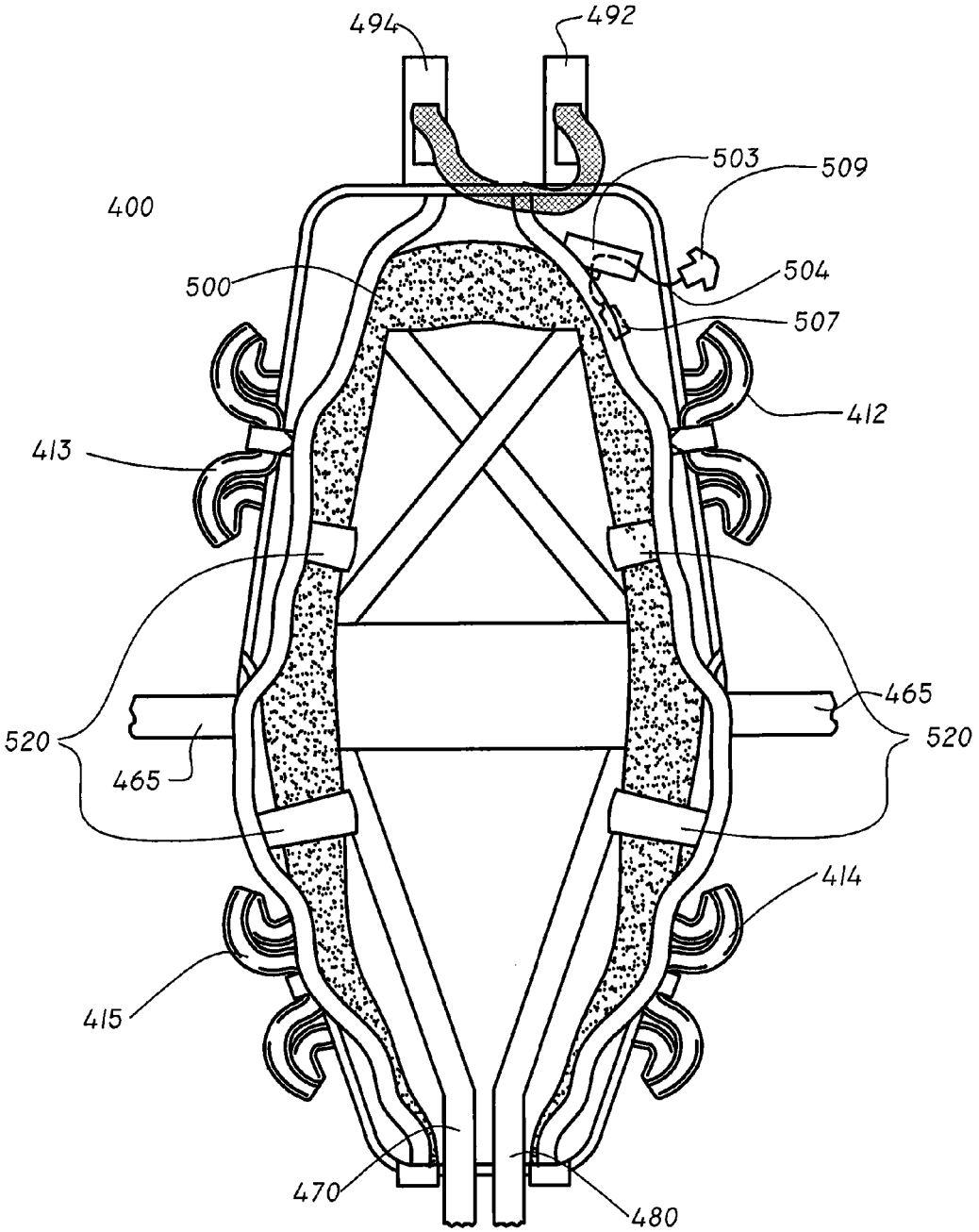
FIG. 8 shows the interior cavity of the rescue device with internal bladder inflated.

Harness bag 100 preferably includes an internal bladder 500, as shown in FIG. 8. For clarity, shoulder straps 440A, 440B, distal ends of first and second leg straps 470, 480 and distal ends of waist strap 465 are not shown.

FIG. 8 shows reclosable opening 101 opened to expose bladder 500 and a plurality of bladder retainers 520 provided within harness bag 100. As shown in FIG. 8, bladder 500 is in the inflated state, retained by bladder retainers 520. A handle retainer 503 (FIGS. 5-6, 8), such as a pocket or snap connect, is provided on the exterior of harness bag 100 to retain handle 509 to trigger inflation of the bladder 500. Handle 509 attaches to cord 504, which attaches to a trigger of canister 507 (FIG. 8), which contains a compressed gas, e.g., carbon dioxide ($CO_2$). Accordingly, pulling handle 509 away from harness bag 100 will tension cord 504 and trigger release of the compressed gas, thereby inflating bladder 500. A manual inflator (not shown) to allow a secured individual or rescuer to manually inflate internal bladder 500 is also provided, in the event of loss of $CO_2$ pressure, trigger malfunction or similar contingency.

Inflation of bladder 500 provides enhanced rigidity for neck and spinal stabilization.

Inflation of bladder 500 also provides buoyancy during water operations, for both the individual (I) being rescued and allowing a care-giver to float alongside while providing aid to the individual (I). Inflatable bladder 500 provides a floatation mechanism to facilitate aquatic rescue and survival, to float the secured individual in a head-up position in salt and fresh water. For purposes of water rescue, a nearly vertical position is maintained when in the water by providing foot ballast, including additional weight of wetted leg protector 300, to assure that the head is always upwardly positioned and to provide self-righting ability to maintain the individual's (I) head above the water at all times.

Figure 9:
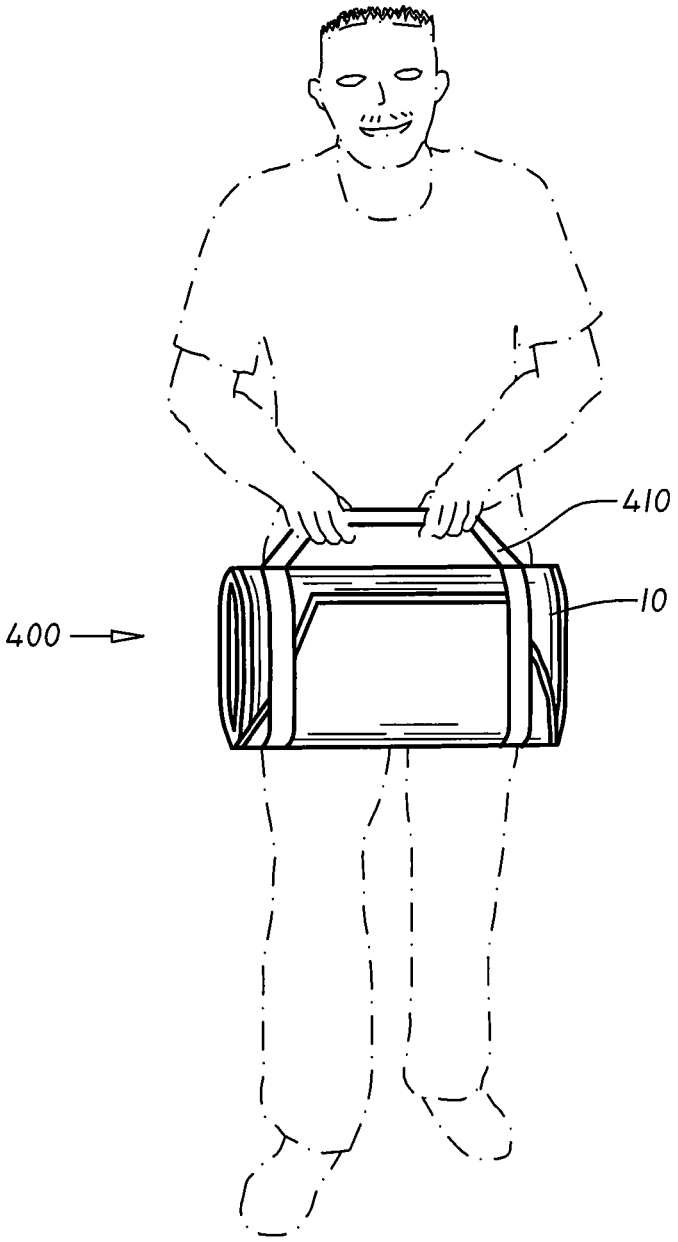
FIG. 9 shows the rescue device in a non-deployed, stored state carried by an emergency service provider.

FIG. 9 shows rescue device 400 in a non-deployed, stored state, carried by an emergency service provider. The weight of rescue device 400 does not exceed 20 lbs without bladder 500, which adds less than another 20 lbs.

It is to be understood that the exemplary embodiments discussed here are merely illustrative of general conceptual frameworks of a rescue stretcher device or rescue sled having a flexible base panel combined with a harness, wherein the harness may include an integral harness bag for protection and stowage of the harness body straps. The harness according to exemplary embodiments of the invention can be designed for different applications and can include any type of harness systems such as full-body harnesses or rescue harness frameworks that otherwise meet NFPA (National Fire Protection Association) standards (or other regulatory standards) for Class I, Class II, and/or Class III service, depending on the application.

Although illustrative embodiments of the present invention have been described herein with reference to the accompanying drawings, it is to be understood that the invention is not limited to those precise embodiments, and that various other changes and modifications may be affected therein by one skilled in the art without departing from the scope or spirit of the invention.

What is claimed:

1. A rescue device comprising: a base panel; a harness bag removably secured to the base panel; and a plurality of harness straps having proximal ends secured within the harness bag: and an inflatable bladder; a D-ring connector affixed to one end of a waist strap; a first hook affixed to an opposite end of a waist strap; a second hook affixed to each distal end of a plurality of shoulder straps; and a third hook affixed to a distal end of a leg strap, wherein the harness bag includes an interior cavity adapted to retain the inflatable bladder and wherein the rescue device is adapted to secure an individual therein by looping each of the plurality of shoulder straps around the individual's head, looping the one end and opposite end of the waist strap around the individual's waist and securing the first hook and the second hook to the D-ring connector, and extending the leg strap between the individual's legs and securing the third hook to the D-ring connector.

2. The rescue device of claim 1, wherein, when the rescue device is in a non-deployed state, distal ends of each of the plurality of harness straps are releasably secured on an exterior surface of the harness bag, and wherein, to deploy the rescue device, the distal ends of each of the plurality of harness straps are released from the exterior surface of the harness bag and extracted by pulling the plurality of harness straps through the respective slots in the harness bag, with the rescue device being adapted to be deployed in less than one minute.

3. The rescue device of claim 1, further comprising a reclosable opening on the harness bag adapted to provide access to the interior cavity for repacking the plurality of harness straps, to return the rescue device from a deployed state to a non-deployed state.

4. The rescue device of claim 1, further comprising a plurality of fasteners disposed within the interior cavity of the harness bag to releasably secure excess slack of the plurality of harness straps within the interior cavity of the harness bag when the harness is in a non-deployed state.

5. The rescue device of claim 1, wherein the base panel is formed of a flexible, non-shape retaining material.

6. A rescue device comprising:

a base panel;

a harness bag removably secured to the base panel;

a plurality of harness straps retractable from within the harness bag; and a leg protector adapted to removably secure a first end thereof to a bottom end of the rescue device, with the first end of the leg protector being removably secured between the base panel and the harness bag, and a second end of the leg protector extending from the base panel in lengthwise direction.

7. The rescue device of claim 6, wherein, when in a non-deployed state, the base panel is rolled in a lengthwise direction with the harness bag and the leg protector contained therein.

8. A method for operating a rescue device, the method comprising:

unrolling a base panel to expose a harness bag removably secured therein, to expose a surface of the harness bag;

releasing distal ends of a plurality of harness straps from the surface of the harness bag;

extracting the plurality of harness straps from an interior cavity of the harness bag wherein proximal ends of each harness strap remain secured within the harness bag; and securing an individual in the rescue device by looping the extended harness straps around the individual and interconnecting distal ends of the harness straps.

9. The method for operating a rescue device of claim 8, wherein, when the rescue device is in a non-deployed state, excess slack of each harness strap is releasably secured within the harness bag and distal ends of each harness strap are releasably secured on an exterior surface of the harness bag, thereby containing the harness straps in the harness bag.

10. The method for operating a rescue device of claim 8, wherein the plurality of harness straps include shoulder straps with distal ends thereof configured to interconnect with distal ends of a waist strap.

11. The method for operating the rescue device of claim 8, wherein a plurality of fasteners are disposed within the interior cavity of the harness bag to releasably secure excess slack of the plurality of harness straps within the interior cavity of the harness bag when the harness is in a non-deployed state.

* * * * *